US010597742B2

(12) United States Patent
Wang et al.

(10) Patent No.: US 10,597,742 B2
(45) Date of Patent: Mar. 24, 2020

(54) LOW-TEMPERATURE HIGH-STRENGTH-AND-DUCTILITY HIGH MANGANESE STEEL, AND HIGH MANGANESE STEEL PLATE AND HIGH MANGANESE STEEL TUBE MANUFACTURING PROCESS

(71) Applicant: Yanshan University, Qinhuangdao (CN)

(72) Inventors: Yu hui Wang, Qinhuangdao (CN); Xiao xu Huang, Qinhuangdao (CN); Tian sheng Wang, Qinhuangdao (CN); Yan Peng, Qinhuangdao (CN); Yan ming He, Qinhuangdao (CN); Ya nan Zheng, Qinhuangdao (CN); Bo Liao, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 0 days.

(21) Appl. No.: 15/310,085

(22) PCT Filed: Apr. 15, 2015

(86) PCT No.: PCT/CN2015/076653

§ 371 (c)(1),
(2) Date: Nov. 9, 2016

(87) PCT Pub. No.: WO2016/023383

PCT Pub. Date: Feb. 18, 2016

(65) Prior Publication Data

US 2017/0283896 A1 Oct. 5, 2017

(30) Foreign Application Priority Data

Aug. 14, 2014 (CN) ..... 2014 1 0399638
Aug. 14, 2014 (CN) ..... 2014 1 0399639

(51) Int. Cl.
*B21B 1/02* (2006.01)
*B21B 1/30* (2006.01)
(Continued)

(52) U.S. Cl.
CPC ..... *C21D 9/08* (2013.01); *B21B 1/026* (2013.01); *B21B 1/30* (2013.01); *B21B 3/02* (2013.01);
(Continued)

(58) Field of Classification Search
None
See application file for complete search history.

(56) References Cited

FOREIGN PATENT DOCUMENTS

CN 101568660 A 10/2009
CN 102776435 A 11/2012
(Continued)

OTHER PUBLICATIONS

Machine-English translation of JP 2007-126715, Okaguchi Hideji, Nov. 4, 2005.*
(Continued)

*Primary Examiner* — Colin W. Slifka
(74) *Attorney, Agent, or Firm* — Knobbe, Martens, Olson & Bear, LLP

(57) ABSTRACT

The present invention discloses a machining technology of a low-temperature high-strength-ductility high manganese steel, high manganese steel plate, and high manganese steel tube, and a high manganese steel comprises the following components in percentage by weight: Mn 30%-36%, C 0.02%-0.06%, S≤0.01%, P≤0.008% and the balance being Fe. Smelted steel ingots are subject to solution treatment and are rolled and homogenized to obtain a high manganese steel plate or are drawn to form a high manganese steel tube. The hot-rolled or cold-rolled steel plate after being hot-rolled has tremendous application value in the fields of low-tempera-
(Continued)

ture applications, such as the steel plate used for a low temperature pressure container.

10 Claims, 12 Drawing Sheets

(51) Int. Cl.

| | |
|---|---|
| ***B21C 1/00*** | (2006.01) |
| ***B21C 1/22*** | (2006.01) |
| ***C21D 1/18*** | (2006.01) |
| ***C21D 6/00*** | (2006.01) |
| ***C21D 8/02*** | (2006.01) |
| ***C21D 8/10*** | (2006.01) |
| ***C21D 9/08*** | (2006.01) |
| ***C22C 38/00*** | (2006.01) |
| ***C22C 38/04*** | (2006.01) |
| ***B21B 3/02*** | (2006.01) |
| *C21D 1/26* | (2006.01) |
| *B21B 1/22* | (2006.01) |

(52) U.S. Cl.

CPC ..... *B21C 1/003* (2013.01); *B21C 1/22* (2013.01); *C21D 1/18* (2013.01); *C21D 6/005* (2013.01); *C21D 8/02* (2013.01); *C21D 8/021* (2013.01); *C21D 8/0205* (2013.01); *C21D 8/0236* (2013.01); *C21D 8/0263* (2013.01); *C21D 8/105* (2013.01); *C22C 38/002* (2013.01); *C22C 38/04* (2013.01); *B21B 2001/221* (2013.01); *C21D 1/26* (2013.01); *C21D 8/0221* (2013.01)

(56) References Cited

FOREIGN PATENT DOCUMENTS

| | | | |
|---|---|---|---|
| CN | 104152797 | A | 11/2014 |
| CN | 104259229 | A | 1/2015 |
| JP | 0762432 | A | 3/1995 |
| RU | 2023738 | C1 | 11/1994 |

OTHER PUBLICATIONS

Saleh A.A., Gazder A.A., and Pereloma E. (2013). EBSD observations of recrystallisation and tensile deformation in twinning induced plasticity steel. Transactions of the Indian Institute of Metals. 66(5-6):621-629.

Curtze, S., & Kuokkala, V.T., (2010). Dependence of tensile deformation behavior of TWIP steels on stacking fault energy, temperature and strain rate. Acta Materialia. 58:5129-5141.

Koyama, M., Sawaguchi, T., and Tsuzaki, K. (2011). Work hardening and uniform elongation of an ultrafine-grained Fe-33Mn binary alloy. Mater. Sci. Eng. A. 530:659-663.

Koyama, M., Lee, T., Lee, C.S., and Tsuzaki, K. (2013). Grain refinement effect on cryogenic tensile ductility in a Fe—Mn—C twinning-induced plasticity steel. Mater. Design. 49:234-241.

Fang X., Yang P., Lu F, and Meng L. (2011). Dependence of deformation twinning on grain orientation and texture evolution of high manganese TWIP steels at different deformation temperatures. Journal of Iron and Steel Research, International. 18(11):46-52.

International Search Report dated Jul. 22, 2015 in PCT/CN2015/076653 filed Apr. 15, 2015.

Written Opinion dated Jul. 15, 2015 in PCT/CN2015/076653 filed Apr. 15, 2015.

* cited by examiner

LOW-TEMPERATURE HIGH-STRENGTH-AND-DUCTILITY HIGH MANGANESE STEEL, AND HIGH MANGANESE STEEL PLATE AND HIGH MANGANESE STEEL TUBE MANUFACTURING PROCESS

TECHNICAL FIELD

The present invention belongs to the field of steel and iron materials as well as machining and preparation thereof, and particularly relates to a machining technology of a low-temperature high-strength-ductility high manganese steel, high manganese steel plate, and high manganese steel tube.

BACKGROUND ART

As is well-known, the low-temperature brittle fracture of steel is one of the most dangerous failures of a steel structure, the steel material features a brittle fracture at low temperature, and generally the steel and iron material has the following features when the brittle fracture occurs: (1) the operating stress born in fracture is lower than the yield limits; (2) once the brittle fracture occurs, it spreads at a very high speed (2000 m/s or higher); (3) the fracture is flat and straight, the reduction of area is small, and there is no macroscopic deformation feature on the exterior appearance; and (4) the appearance of fracture is generally an intergranular fracture. Once the brittle failure occurs, there will be significant losses, for example, in the World War II, there were about 1000 Liberty ships having brittle fractures.

Therefore, to continuously improve the low-temperature plasticity of the material becomes a research and test hotspot. At present, there are mainly two types of steel and iron materials widely used at low temperature. One type is low-carbon martensite low-temperature steel which is mainly 3.5% Ni, 5% Ni and 9% Ni steels. This type of steel plate can meet requirements on properties, but is expensive due to the high content of nickel; the other type is austenite low-temperature steel which mainly includes steel grades such as AISI304, 304LN, 316, 316LN and 310, and its chemical components are shown in table 1; this type of steel grade is low in low-temperature strength; although the low-temperature strength of the steel grades 304LN and 316LN is improved to certain extent by means of nitrogen strengthening, this type of steel is likely to have martensitic phase transformation that generates magnetism and stress. Consequently, the two types of steel described above have disadvantages that are insurmountable technically and economically.

SUMMARY OF THE INVENTION

The present invention aims at solving the technical problem for providing a machining technology of a low-temperature high-strength-ductility high manganese steel, high manganese steel plate, and high manganese steel tube. The percentage by weight of manganese in the components of the low-temperature high-strength-ductility high manganese steel is increased, smelted steel ingots are subject to solution treatment and are rolled and homogenized to obtain a high manganese steel plate or are drawn to form a high manganese steel tube. The hot-rolled or cold-rolled steel plate after being hot-rolled has tremendous application value in the fields of low-temperature applications.

In order to solve the technical problem described above, the present invention adopts a technical proposal 1 as follows:

a low-temperature high-strength-ductility high manganese steel comprises the following components percentage by weight: Mn 30%-36%, C 0.02%-0.06%, S≤0.01%, P≤0.008% and the balance being Fe.

The percentage by weight of manganese is preferably 32-35% and more preferably 34-34.5%.

In the technical proposal described above, the content of manganese is increased to 32% or higher, after the smelted steel ingot is subjected to solution treatment and tempering homogenization, it features optimal ductility, high yield strength and high tensile strength at low temperature, and fractograph shows dimples.

The present invention further provides a technical proposal 2:

a machining technology of a low-temperature high-strength-ductility high manganese steel plate comprises steps of smelting high manganese steel, post-treating steel ingot, cogging and rolling to form a plate, and the process steps comprise the following parameters:

A. smelting the high manganese steel: calculating a charging ratio according to the percentage by weight of components in the high manganese steel: Mn 30%-36%, C 0.02%-0.06%, S≤0.01%, P≤0.008% and the balance being Fe, and smelting the components into the steel ingot;

B. post-treating the steel ingots: keeping the steel ingot smelted in step A under the condition of 1150 DEG C.-1200 DEG C. and performing heat treatment for 2-4 hours, and then transferring the steel ingot into a water quenching tank at room temperature to complete solid solution treatment; and

TABLE 1

Chemical components of commonly-used low-temperature steel

| | Serial number | Chemical component (wt. %) | | | | | | |
|---|---|---|---|---|---|---|---|---|
| | | Cr | Ni | C | Si | Mn | S | P |
| Austenite steel | 304 (00Cr18Ni9) | 18-20 | 8-12 | 0.03 | — | — | ≤0.03 | ≤0.03 |
| | 310s (Cr25Ni20Si) | 24-26 | 19-22 | 0.08 | 1.5 | — | ≤0.03 | ≤0.03 |
| | 316 (Cr18Ni12Mo2Ti) | 16-18 | 10-14 | 0.08 | — | — | ≤0.03 | ≤0.03 |
| | 316L (00Cr17Ni12Mo2Ti) | 16-18 | 10-14 | 0.03 | — | — | ≤0.03 | ≤0.03 |
| | 321 (1Cr18Ni9Ti) | 17-19 | 9-12 | 0.08 | — | — | ≤0.03 | ≤0.03 |
| Nickel steel | 3.5 Ni | — | 3.25-3.75 | ≤0.15 | — | — | ≤0.005 | ≤0.02 |
| | 5 Ni | — | 4.75-5.25 | ≤0.15 | — | — | ≤0.005 | ≤0.02 |
| | 9 Ni | — | 8.5-9.5 | ≤0.13 | 0.15-0.4 | ≤0.9 | ≤0.04 | ≤0.035 |

C. cogging and rolling the steel ingot to form a plate: performing hot rolling, tempering and homogenizing after cogging the steel ingot after solid solution treatment.

The content of Mn in percentage by weight in the components of high manganese steel in step A is preferably 32%-35%.

The material components of the present invention belong to a scope of super-high manganese steel. It is generally believed that high manganese steel features brittle-ductile transition under low temperatures, and its low temperature fracture modes are predominately intergranular brittle failure when the content of manganese exceeds 30%. The content of manganese is increased to 30-36% in the above technical solution, and the crude plate prepared after hot rolling and homogenization features optimal ductility and higher yield strength and tensile strength at low temperature, and the fractograph shows dimples.

Step D is performed on the crude plate after being hot rolled in the above technical solution: after hot rolling, homogenizing the crude plate, performing cold rolling, annealing and homogenizing to form shape. Conditions of cold rolling, annealing and homogenizing are: performing 10-20 cold rolling passes at room temperature on the crude plate after being hot rolled and homogenized to form a plate with a thickness of 1.0 mm to 2.0 mm, the rolling deformation is 90% to 93%, and the steel plate is maintained under 500 DEG C.-1000 DEG C. for 0.5-2 hours, then transferred to a water quenching tank at room temperature for homogenization.

Cold-roll the crude plate after being hot rolled and homogenized again to form a thin steel plate with a tensile strength still higher than the requirement of relevant standards. The steel plate (1.0-2.0 mm) obtained by cold rolling and annealing has different grain sizes and different fracture behaviors under different treatment conditions. When used at low temperature (−170 DEG C. to −196 DEG C.) under annealing condition of 500 DEG C. to 710 DEG C., the yield strength reaches 525 to 612 MPa ($\sigma 0.2$), and even reaches 1018 MPa, the tensile strength reaches 958-982 MPa ($\sigma b$), and even up to 1193 MPa; and the uniform elongation reaches 40.0 to 53.7%; when used at low temperature (−170 DEG C. to −196 DEG C.) under the condition of 800 DEG C. to 1000 DEG C., the yield strength reaches 413 to 456 MPa ($\sigma 0.2$), the tensile strength reaches 620 to 754 MPa ($\sigma b$), and the uniform elongation reaches 8.8 to 18.0%, which is applicable to low temperature.

The present invention further provides a technical proposal 3:

A machining technology of a low-temperature plastic high manganese steel tubular product comprises steps of smelting high manganese steel, post-treating steel ingot, and cogging and rolling to form a plate, and the process steps comprise the following parameters:

step A. calculating a feeding ratio according to the percentage by weight of components in the high manganese steel: Mn 30%-36%, C 0.02%-0.06%, S≤0.01%, P≤0.008% and the balance being Fe, and smelting the components into the steel ingot;

step B. post-treating the steel ingot: maintaining the steel ingot smelted in step A under the condition of 1150 DEG C.-1200 DEG C., performing heat treatment for 2-4 hours, and then transferring the steel ingot into the room temperature water quenching tank to complete solid solution treatment; and step C. cogging and drawing to obtain the tubular product: performing hot rolling, tempering and homogenizing on the steel ingot after cogging the steel ingot on which solid solution treatment is performed.

step D: cold-drawing the tubular product at room temperature after hot drawing and homogenizing into a thin-wall tubular product with a wall thickness of 1.0 mm-2.0 mm, maintaining the thin-wall tubular product at 600 DEG C. to 850 DEG C. for 0.5-2 hours, and then transferring into a water quenching tank at room temperature for homogenization.

The advantageous effects produced by applying the above technical solution lie in: (1) the low-temperature high-strength-ductility steel plate of the present invention has simple components, low cost, and its cost is greatly reduced particularly when it is used in low temperature field to replace high-nickel steel; (2) the heat treatment process is simple, applicable to scale production, and is energy saving and environmental protection, and the manufacturing technique is simple, and easy to implement; and (3) the processed steel plate and steel pipe can be suited for low temperature environment, especially for environment of −170 DEG C. to −196 DEG C., and can be used for the preparation of low temperature pressure vessel.

Figure 20:
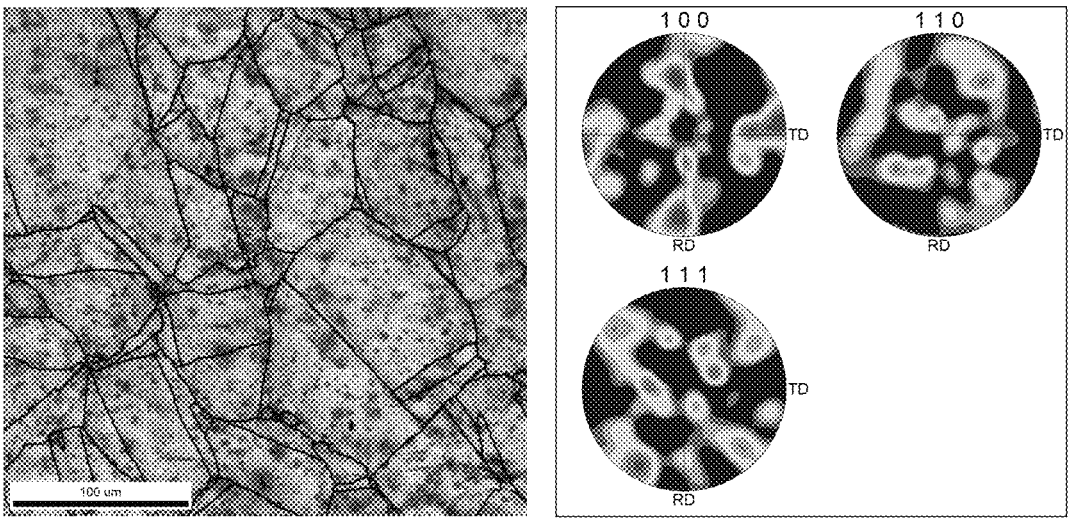
Figure 21:
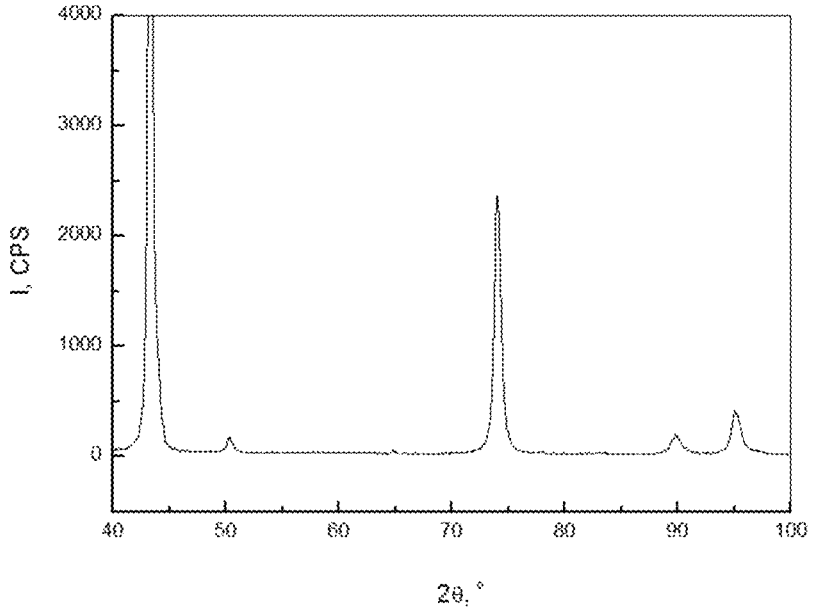
Figure 22:
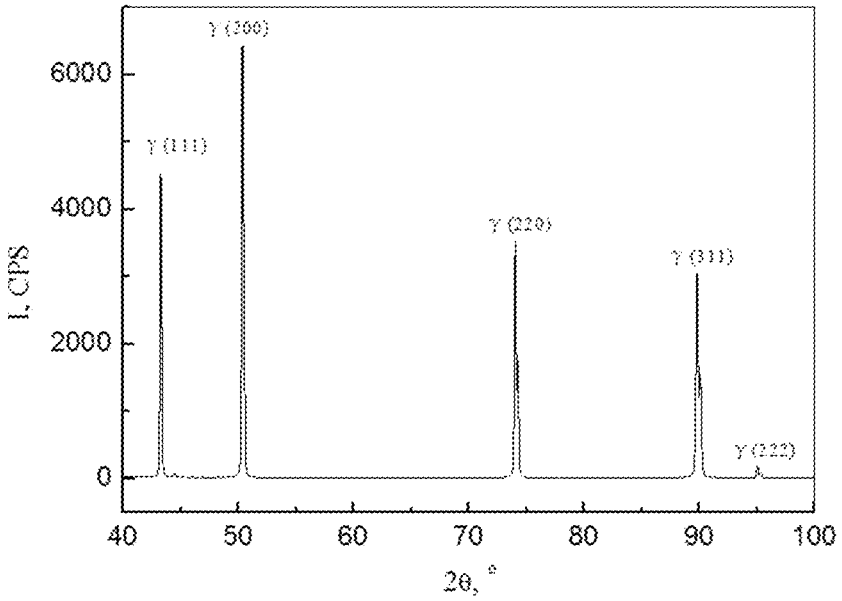
Figure 23:
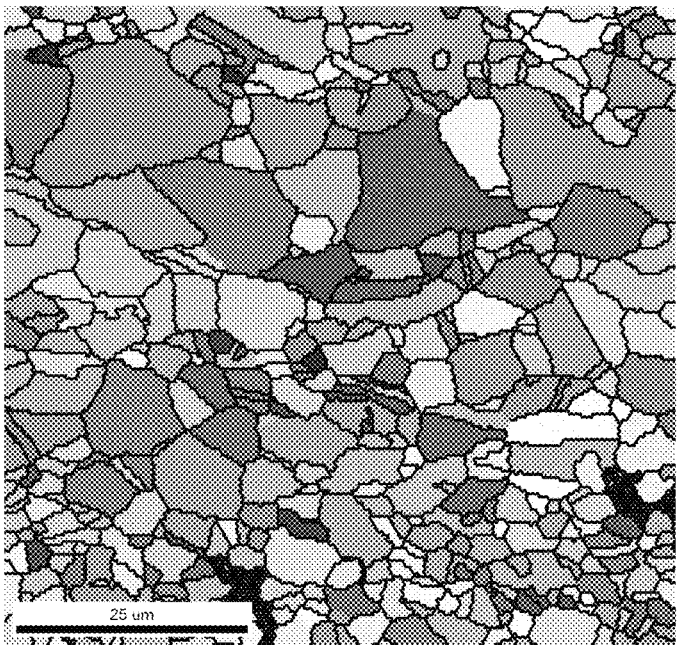
Figure 24:
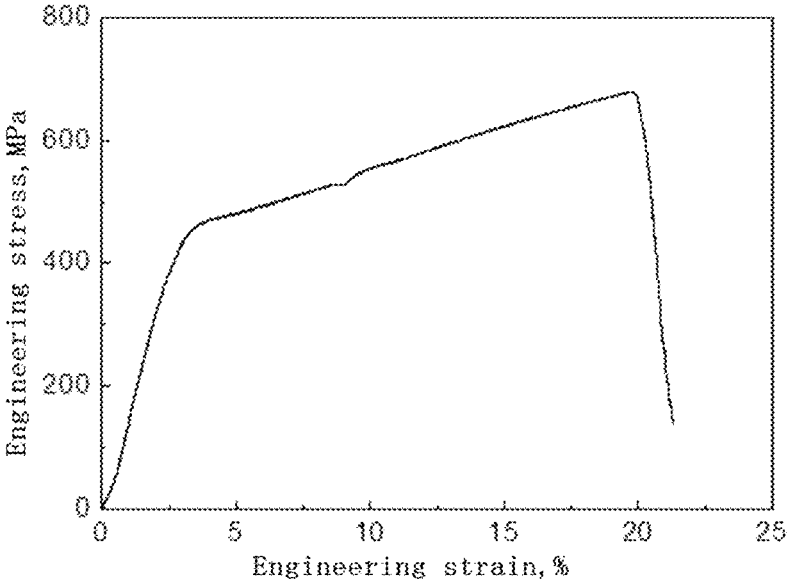
Figure 25:
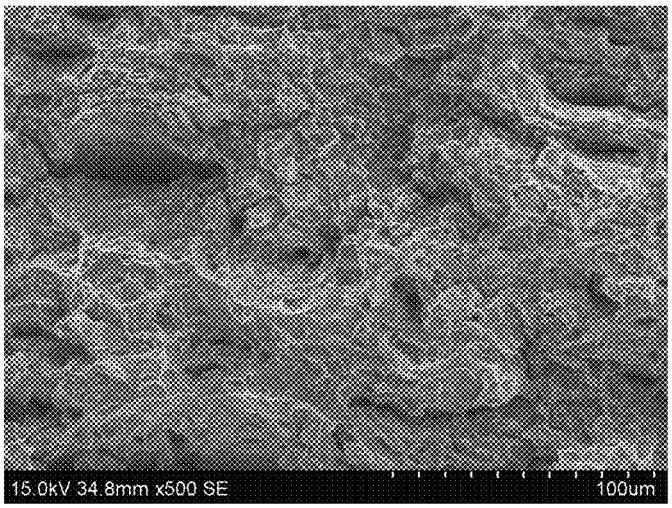
Figure 26:
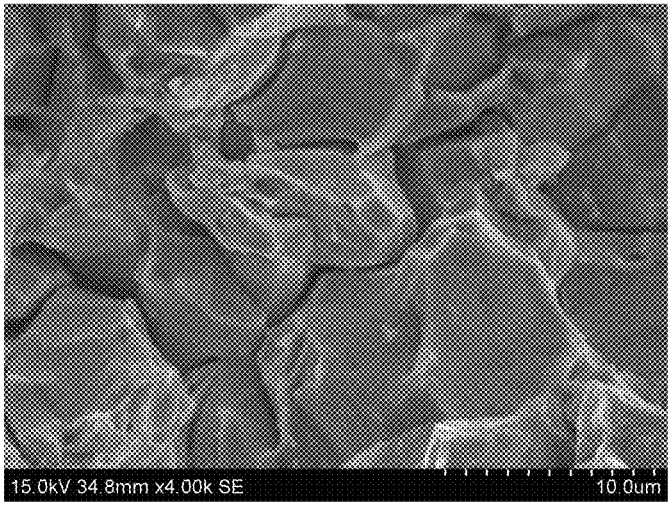
Figure 27:
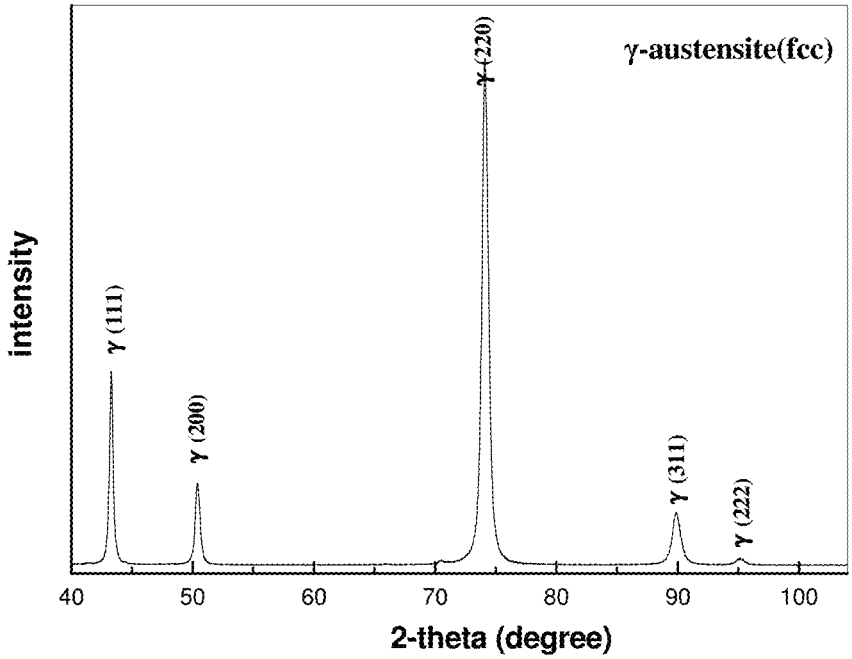
Figure 28:
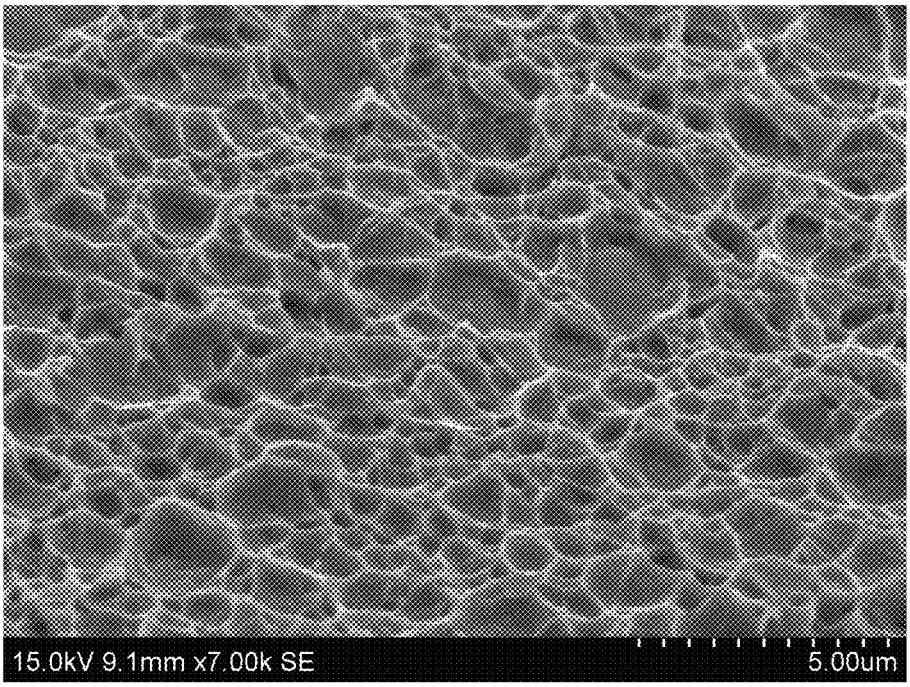

[1] Koyama, M., Lee, T., Lee, C. S., and Tsuzaki, K. (2013). Grain refinement effect on cryogenic tensile ductility in a Fe—Mn—C twinning-induced plasticity steel. Mater. Design. 49, 234-241;

[2] Koyama, M., Sawaguchi, T., and Tsuzaki, K. (2011). Work hardening and uniform elongation of an ultrafine-grained Fe-33Mn binary alloy. Mater. Sci. Eng. A. 530, 659-663;

[3] Ahmed A. Saleh, Azdiar A. Gazder, Elena V. Pereloma. (2013). EBSD observation of recrystallisation and tensile deformation in twinning induced plasticity steel. Transactions of the Indian institute of Metal. 66(5-6), 621-629;

[4] Curtze, S., Kuvokkala, V. T., (2010). Dependence of tensile deformation hehavior of TWIP steels on stacking fault energy, temperature and strain rate. Acta Mater. 58, 5129-5141;

[5] Xiuhui Fang, Ping Yang, Fayun Lu, li Meng. (2011). Dependence of deformation twinning on grain orientation and texture evolution of high manganese TWIP steels at different deformation temperatures. Journal of Iron and steel research, International. 18(11). 46-52;

FIG. 20 is an EBSD orientation map of a steel ingot after hot rolling and homogeneous in embodiment 10;

FIG. 21 is an XRD diffractograms of a tubular product obtained after cold rolling in embodiment 11;

FIG. 22 is an XRD diffractograms of a tubular product obtained after cold rolling and annealing in embodiment 11;

FIG. 23 is an EBSD orientation map of a tubular product obtained in embodiment 11;

FIG. 24 is an engineering stress-engineering strain curve of a tubular product tensile at −180 DEG C. in embodiment 11;

FIG. 25 and FIG. 26 are SEM scanning photographs of tensile fracture surfaces of a tubular product in embodiment 10 respectively;

FIG. 27 is an XRD diffractogram of a parallel end of a fracture surface after being tensile at −196 DEG C. in embodiment 7;

FIG. 28 is an SEM photograph of a fracture surface after being snapped at −196 DEG C. in embodiment 7.

DETAILED DESCRIPTION OF THE INVENTION

Embodiment 1

A high manganese steel in this embodiment comprising the following components in percentage by weight: Mn 34%, C 0.04%, S≤0.01%, P≤0.008% and the balance being Fe and unavoidable impurities. Strictly limit the content of S and P. Specific processing steps are as follows:

A. Calculating a feeding ratio according to the foregoing percentage by weight of the high manganese steel, and smelting in the line frequency electric induction furnace and argon plus pressure ambient in the furnace, so as to prevent the volatilization of the Mn during smelting, and smelting to form a steel ingot.

B. Post-treating the steel ingot: keeping the steel ingot smelted in step A under the condition of 1150 DEG C.-1200 DEG C. and performing heat treatment for 2-4 hours, and then transferring the steel ingot into a water quenching tank at room temperature to complete solid solution treatment; after solid solution treatment, dissolving phases in the cast ingot, which is advantageous for improving toughness and corrosion resistance of the high manganese steel, and relieving stress and softening.

C. Cogging and rolling the steel ingot to form a plate: performing hot rolling, tempering and homogenizing after cogging the steel ingot after solid solution treatment.

Technological conditions for hot rolling and homogenizing are: first, heating a crude plate to 800-1000 C; then, carrying out hot rolling into a tube with a wall thickness of 10-20 mm; after that, maintaining for 1-2 hours at 1000-1100 DEG C.; then, transferring to a room-temperature water quenching tank for homogenization. After hot rolling, homogenization is performed to cancel stress concentration point caused by hot rolling.

Figure 1:
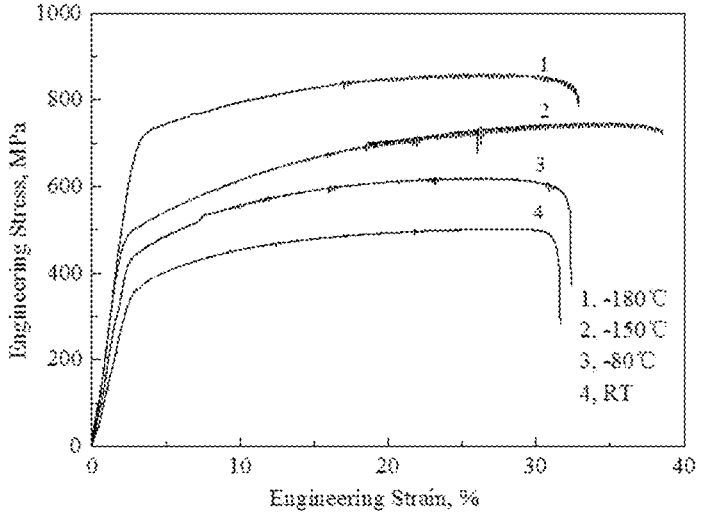
FIG. 1 is an engineering stress-engineering strain curve of a steel plate tensile under different temperatures in embodiment 1.

The thickness of the crude plate during hot rolling in the embodiment is 13 mm, and a tensile test is performed on the crude plate according to GB/T 13239-2006 (metal material tensile test method at low temperature), and tensile strain rate is $10^{-3}$ $s^{-1}$, and averaged results can be seen in Table 2, and the engineering stress-engineered strain curve can be seen in FIG. 1.

TABLE 2

Crude plate tensile performance test after hot rolling and homogenizing in embodiment 1

| Number | Tensile Temperature (DEG C.) | Yield strength ($\sigma_{0.2}$), MPa | Tensile strength ($\sigma_b$), MPa | Elongation percentage, % | Fracture type |
|---|---|---|---|---|---|
| 1 | Room temperature (RT) | 372.6 | 503.5 | 28.6 | Dimple fracture |
| 2 | −20 | 465.2 | 584.11 | 23.0 | |
| 3 | −40 | 479.8 | 627.0 | 24.0 | |
| 4 | −80 | 465.9 | 632.0 | 27.0 | |
| 5 | −120 | 526.1 | 694.4 | 21.2 | |
| 6 | −150 | 512.8 | 762.6 | 37.9 | |
| 7 | −180 | 577.2 | 821.5 | 33.0 | |

Embodiment 2

On the basis of embodiment 1, step D is further comprised: after hot rolling, homogenizing the crude plate, performing cold rolling, annealing and homogenizing to form shape.

Figure 2:
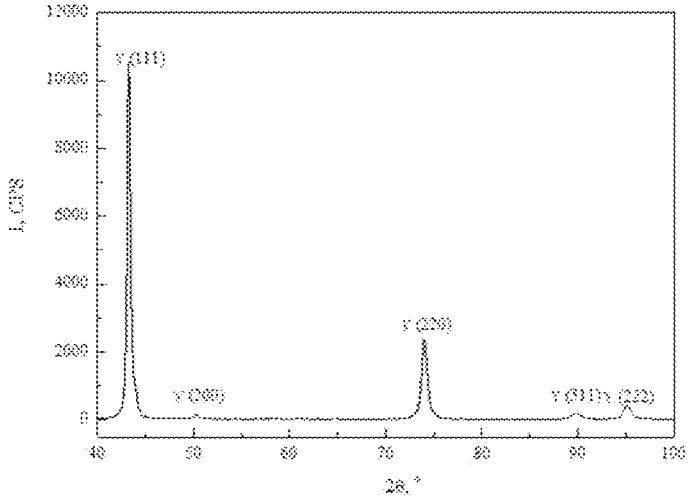
FIG. 2 is an XRD diffractograms of a steel plate obtained after being hot rolled and cold rolling of a steel ingot in embodiment 2.

Conditions for cold-rolling are: cold rolling is performed on the crude plate after hot rolling and homogenizing for 10-20 times into steel having a thickness of 1 mm-2.0 mm, rolled deformation reduction is 90%-93%, an XRD test is performed on this sample, and its XRD diffractograms can be seen in FIG. 2.

Figure 3:
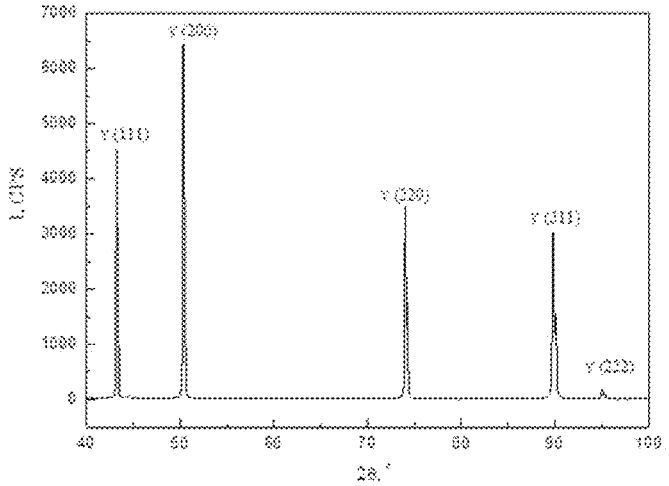
FIG. 3 is an XRD diffractograms of a steel plate obtained after being hot rolled, cold rolling annealing of a cast ingot in embodiment 2.
Figure 4:
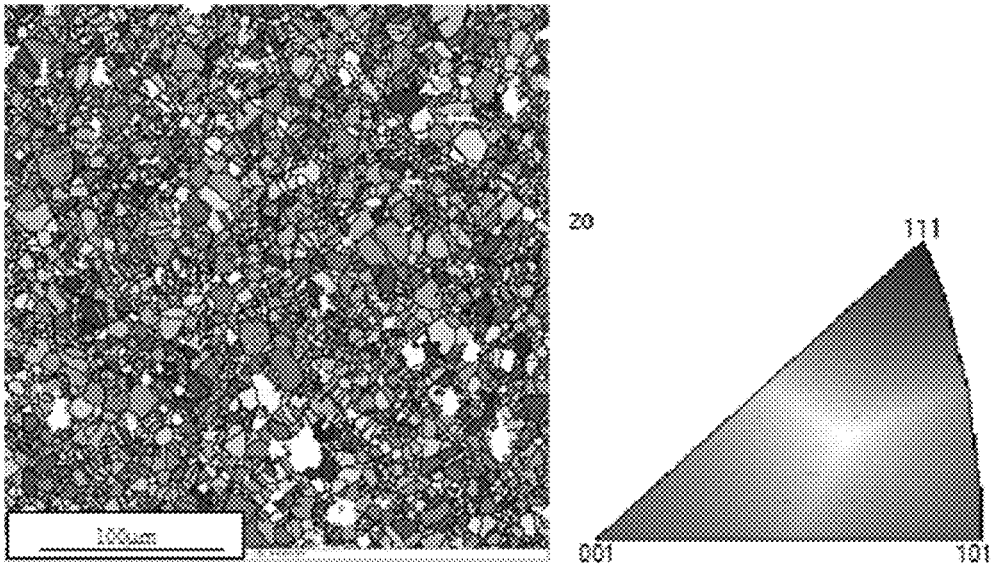
FIG. 4 is an EBSD orientation map of a steel plate obtained after being hot rolled, cold rolling annealing of a cast ingot in embodiment 2.

Annealing and homogenizing to form shape: the steel plate obtained by cold rolling is annealed at 700 DEG C. for 1 hour and is transferred for homogenization at room-temperature in a water quenching tank by annealing, and the high-manganese steel plate is obtained, which then experiences an XRD test and an EBSD (Electron Backscatter Pattern) test, as shown in FIGS. 3-4 respectively.

As can be seen in FIG. 2, a cold-rolled steel plate is an austenite structure with a fully face-centered cubic structure. As can be seen in FIG. 3, the steel plate is still the austenite structure with the complete face-centered cubic structure after undergoing annealing of 800 DEG C. for 1 hour and no phase transition occurs. The average grain size of the steel plate shown in FIG. 4 is 3.8 μm.

The prepared steel plate in the embodiment undergoes a tensile test according to GB/T 13239-2006 (a metal material low-temperature tensile test method), and the tensile conditions and test results are shown in Table 3.

TABLE 3

Tensile test results of the embodiment 2

| Number | Tensile Temperature (DEG C.) | Yield strength ($\sigma_{0.2}$), MPa | Tensile strength ($\sigma_b$), MPa | Elongation percentage, % | Fracture type |
|---|---|---|---|---|---|
| 1 | Room temperature | 273.9 | 564.1 | 38.5 | Dimple fracture |
| 2 | −20 | 285.1 | 615.3 | 44.1 | |
| 3 | −80 | 330.1 | 696.8 | 46.2 | |
| 4 | −120 | 382.0 | 764.9 | 40.7 | |
| 5 | −150 | 410.9 | 811.4 | 39.8 | |
| 6 | −170 | 430.6 | 781.4 | 24.0 | |
| 7 | −180 | 456.4 | 754.4 | 18.3 | Intergranular fracture |
| 8 | −196 | 460.4 | 740.7 | 18.0 | |

Figure 5:
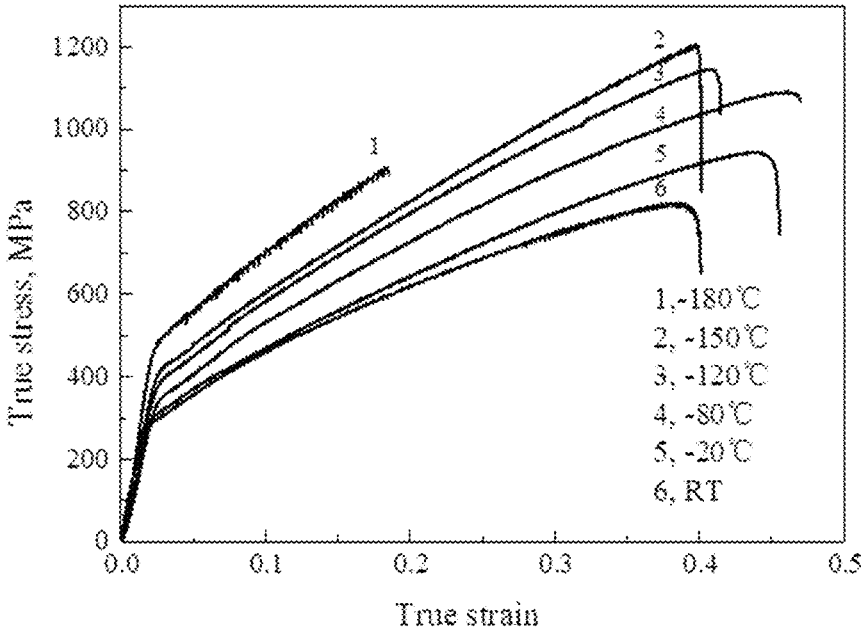
FIG. 5 is a true stress-true strain curve of a steel plate tensile under different temperatures in embodiment 2.
Figure 6:
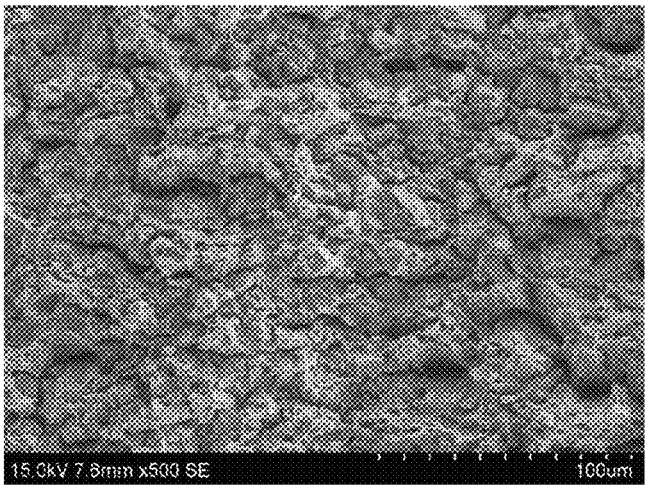
FIG. 6 and FIG. 7 are SEM scanning photographs of the tensile fracture of a steel plate in embodiment 2 respectively.
Figure 7:
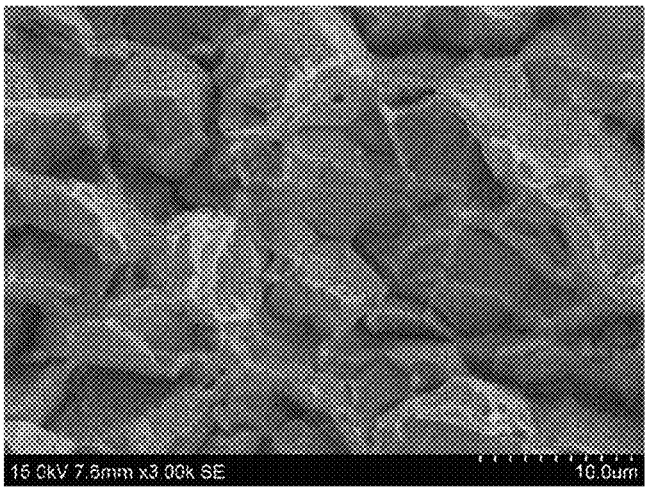

A tensile curve is shown in FIG. 5. It can be seen, from the tensile curve of −180 DEG C., that wave-like uplift appears at a work hardening stage of the curve. An SEM test is conducted on the tensile fracture of a tensile sample at the temperature, as shown in FIGS. 6 and 7, an SEM photograph shows that the tensile sample shows intergranular fracture and belongs to typical brittle fracture. It is generally believed that the intergranular fracture is the brittle fracture, and a material producing the brittle fracture is non-plastic (i.e. the average elongation percentage is smaller than 5%). Although the designed material in the embodiment is of brittle fracture, the uniform elongation is up to 18%, and the material belongs to a plastic material.

Figure 8:
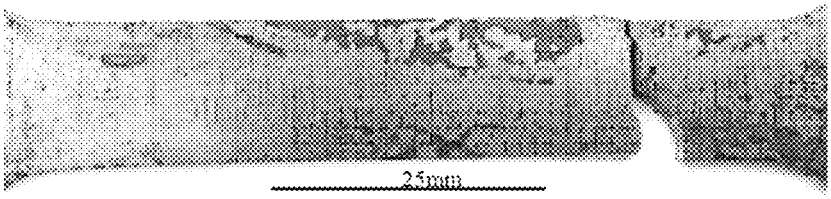
FIG. 8 is an appearance photograph of a steel plate after tensile failure in embodiment 2.

It can be seen, from the appearance photograph (see FIG. 8) after the sample produces the tensile failure, that a large number of micro cracks perpendicular to the tensile direction are distributed on the surface of a thin-walled tube, the micro cracks are produced on the surface of the sample, and the cracks extend for a certain distance and then stop. Crack propagation develops in the tensile direction, the width of cracks is 3 mm to 5 mm, and the depth should be around 4 to 8 micrometers and is about equal to the depth of one or two grain sizes. Preliminary analysis: numerous micro cracks distributed in the surface of the surface of the tensile sample release stress so as to enable the uniform elongation percentage to be above 18%, and the low-temperature plasticity of the type of thin-walled tubes is increased. Further research on a specific mechanism is still needed.

Embodiment 3

Figure 9:
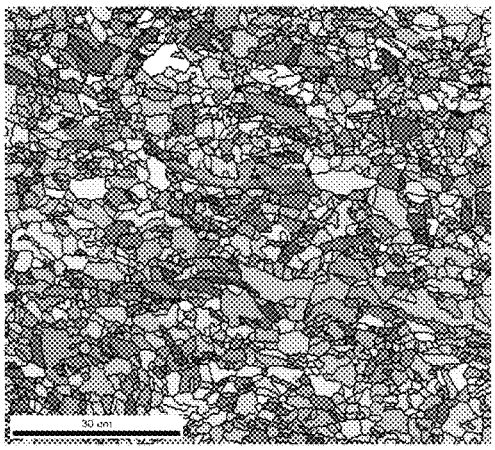
FIG. 9 is an EBSD orientation map of the high manganese steel plate after annealing for 1 hour at 600 DEG C. in embodiment 3.
Figure 10A:
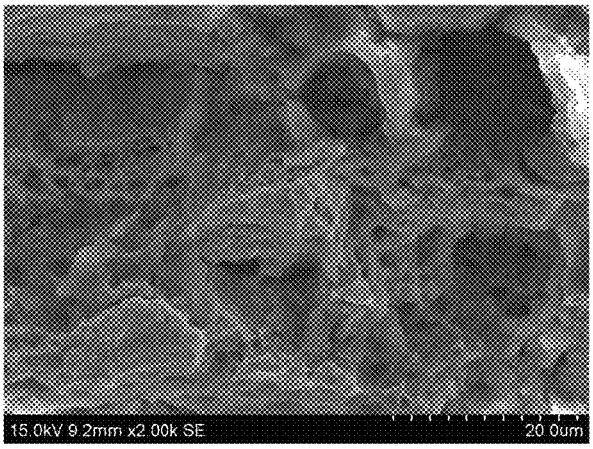
FIG. 10*a* and FIG. 10*b* are SEM photographs of fractures of a high manganese steel plate after tensile at −180 DEG C., respectively in embodiment 3.
Figure 10B:
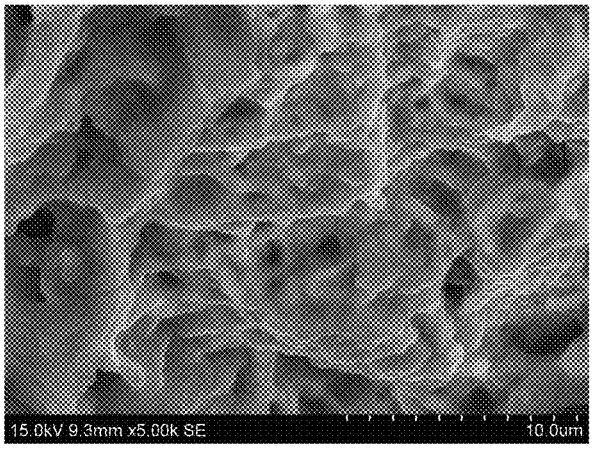
Figure 17:
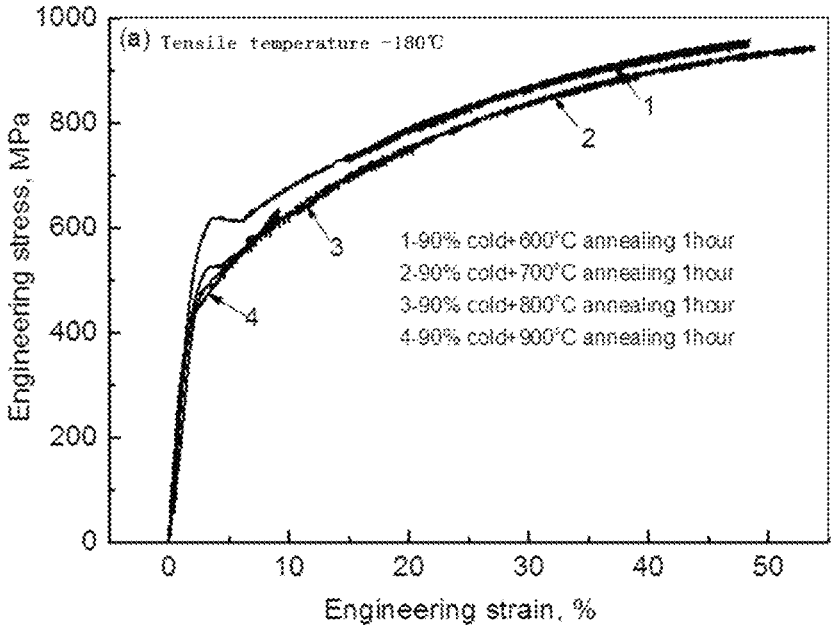
FIG. 17 and FIG. 18 are an engineering stress-engineering strain curve and a true stress-true strain curve of a high manganese steel at −180 DEG C. in embodiments 3-6.
Figure 18:
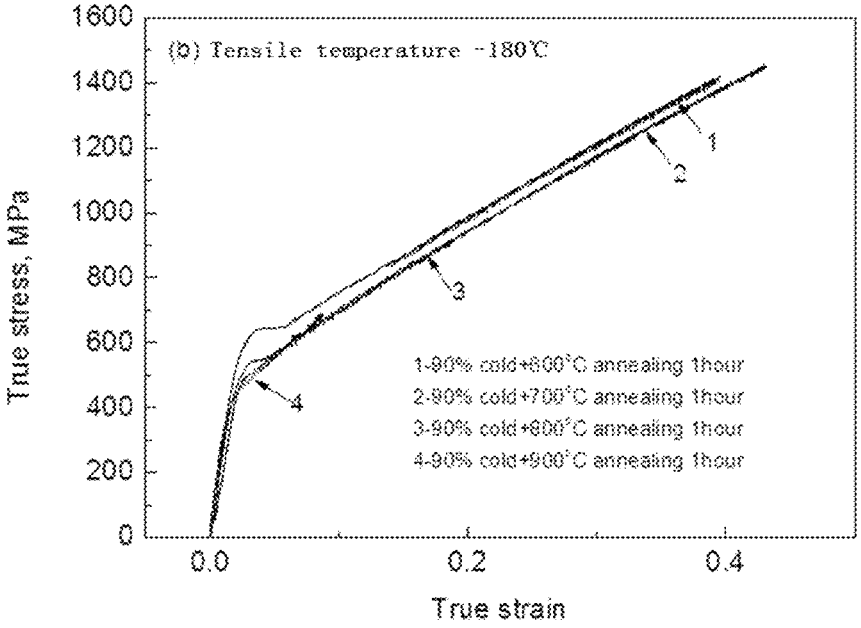

A difference from the embodiment 2 is that: the cold-rolled steel plate is annealed at 600 DEG C. for 1 hour and then is transferred to a room-temperature water quenching pool for annealing and homogenization, and a high-manganese steel plate is obtained and then investigates by EBSD (Electron Backscatter Pattern) test, as shown in FIG. 9; the tensile test is performed at −180 DEG C., an engineering stress-engineering strain curve and a true stress-true strain curve are respectively shown in FIG. 17 and FIG. 18, SEM photographs of the fracture formed after tensile fracture are shown in FIGS. 10*a* and 10*b*.

It can be seen, from FIG. 9, that the average grain size of the high-manganese steel plate in the embodiment is 2.0 m. It can be seen, from, FIG. 17 and FIG. 18, that the yield strength is 612.50 MPa, the tensile strength is 982.92 MPa, the elongation percentage is 49.1%, specific numerical values are shown in Table 4, and the SEM photograph of the fracture shown in FIG. 10 shows that the fracture type is dimple fracture.

Embodiment 4

Figure 11:
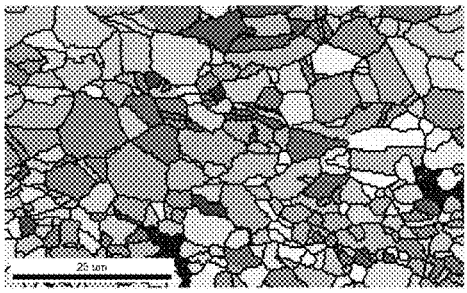
FIG. 11 is an EBSD orientation map of a high manganese steel plate in embodiment 4 after annealing for 1 hour at 700 DEG C.
Figure 12A:
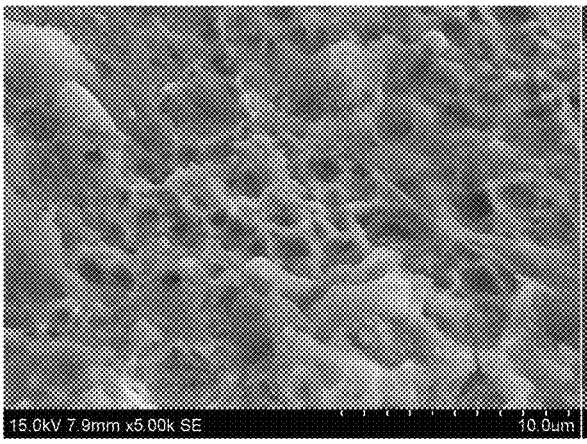
FIG. 12*a* and FIG. 12*b* are fracture surface SEM views of a high manganese steel after being tensile at −180 DEG C. respectively in embodiment 4.
Figure 12B:
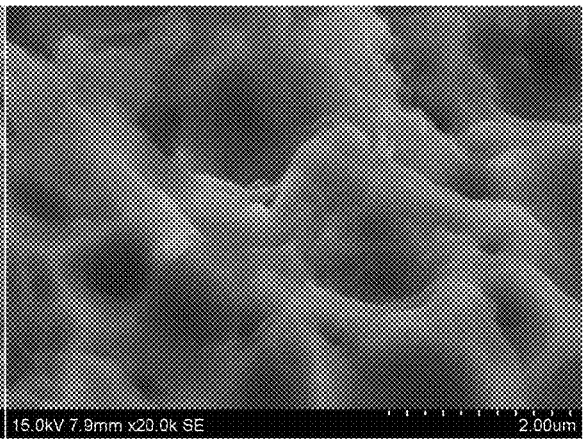

A difference from the embodiment 2 is that: the cold-rolled steel plate is annealed at 700 DEG C. for 1 hour and then is transferred to a room-temperature water quenching pool for annealing and homogenization, and the high-manganese steel plate is obtained and then investigates by EBSD (Electron Backscatter Pattern) test, as shown in FIG. 11. A tensile test is performed at −180 DEG C., an engineering stress-engineering strain curve and a true stress-true strain curve are respectively shown in FIG. 17 and FIG. 18, the yield strength is 525 MPa, the tensile strength is 958 MPa, and the elongation percentage is 53.7%. The specific numerical values are shown in Table 4, and the fracture SEM test after tensile fracture can be shown in 12*a* and 12*b*. The fracture type is a dimple fracture.

Embodiment 5

Figure 13:
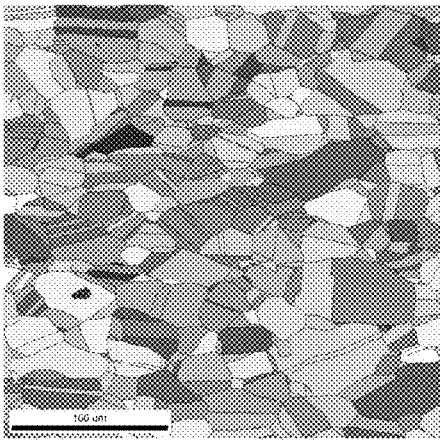
FIG. 13 is an EBSD view of a high manganese steel after annealing for 1 hour at 900 DEG C. in embodiment 5.
Figure 14A:
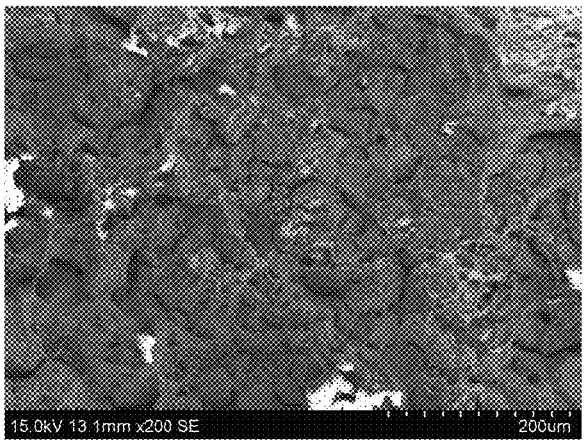
FIG. 14*a* and FIG. 14*b* are fracture surface SEM views of a high manganese steel after being snapped at −180 DEG C. in embodiment 5.
Figure 14B:
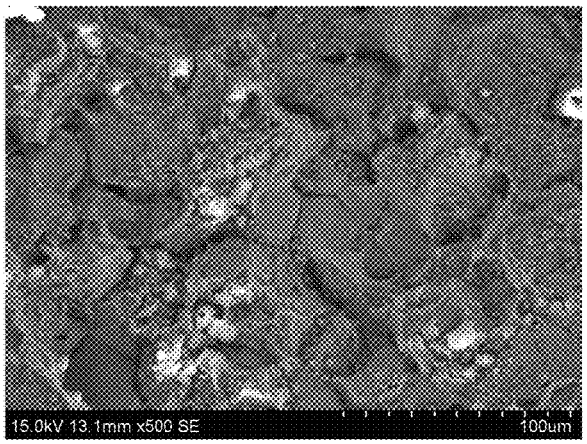

A difference from the embodiment 2 is that: the cold-rolled steel plate is annealed at 900 DEG C. for 1 hour, and an EBSD photograph is shown in FIG. 13. The tensile test is performed at −180 DEG C., the engineering stress-engineering strain curve and the true stress-true strain curve are respectively shown in FIG. 17 and FIG. 18, the specific numerical values are shown in Table 4, and the SEM photographs of the fracture after tensile fracture are shown in 14*a* and 14*b*.

It can be seen, from FIG. 17 and FIG. 18, that the grain size of the steel plate subjected to annealing treatment at 900 DEG C. is 10.8 m, and the fracture type is a dimple fracture. It can be seen, from FIG. 17 and FIG. 18, that the yield strength is 456.4 MPa, the tensile strength is 754.4 MPa, and the elongation percentage is 9.2% at −180 DEG C.

Embodiment 6

Figure 15:
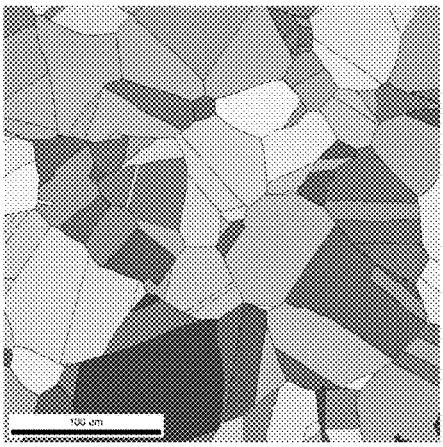
FIG. 15 is an EBSD orientation map of a high manganese steel after annealing for 1 hour at 1000 DEG C. in embodiment 6.
Figure 16A:
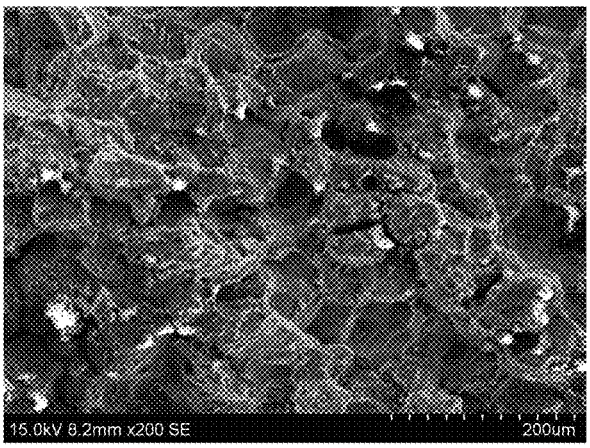
FIG. 16*a* and FIG. 16*b* are fracture surface SEM views of a high manganese steel after being snapped at −180 DEG C. respectively in embodiment 6.
Figure 16B:
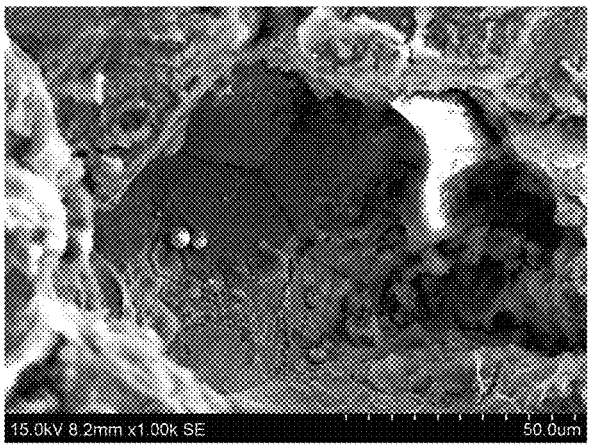

A difference from the embodiment 2 is that: the cold-rolled steel plate is annealed at 1000 DEG C. for 1 hour, an EBSD photograph is shown in FIG. 15, and the SEM photographs after tensile fracture are shown in 16*a* and 16*b*. The engineering stress-engineering strain curves and the true stress-true strain curves are respectively shown in FIG. 17 and FIG. 18, and the specific numerical values are shown in Table 4.

Embodiment 7

A difference from embodiments 1 and 2 is that: the content of Mn is 34.5 wt %, the thickness of a crude plate is 13.8 mm, and in step D, after the 13.8 mm crude plate is cold rolled to a thickness reduction of 92.9%, it is annealed at 550 DEG C. for 1 hour and then transferred to a water quenching tank at room temperature and is subjected to a tensile test. The tensile temperature is −196 DEG C. (liquid nitrogen), and the tensile speed is 1.5 mm/min; test mechanical data include: tensile strength is 1193 MPa, yield strength is 1018 MPa and elongation is 40.0%. Post-breaking fracture parallel ends (referred to a deformation area within a scale distance) are subjected to an XRD test, a fracture is subjected to an SEM test, and results are shown respectively in FIGS. 27 and 28. The results show that no phase change occurs after breaking at −196 DEG C., and the structure is still a stable fully austenitic structure. A post-breaking fracture SEM photograph shows a dimple fracture.

Figure 19:
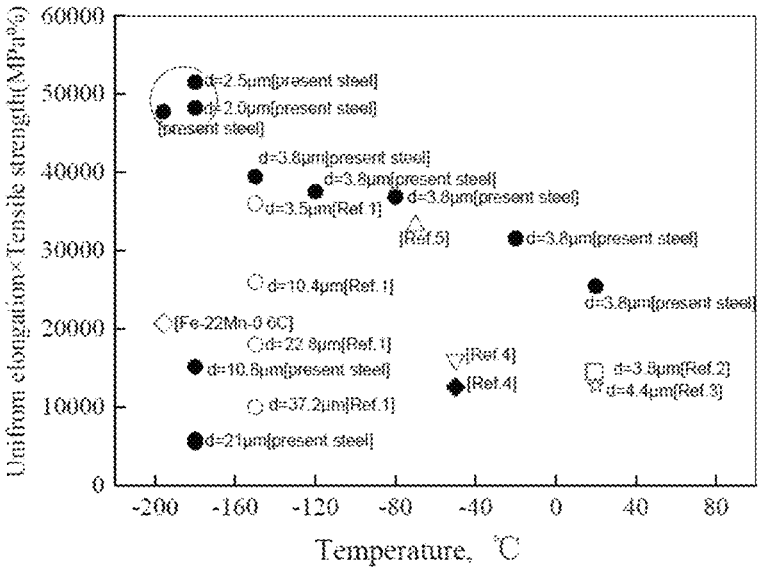
FIG. 19 is a comparative view of a strong strength-ductility of tensile test of a high manganese steel in embodiments 2-7; wherein, ● indicates strong strength-ductility values of manganese steels with different grain sizes at different temperatures in the present invention; ○ indicates the strong strength-ductility value disclosed in reference [1], □ indicates the strong strength-ductility value disclosed in reference [2]; ★ indicates the strong strength-ductility value disclosed in reference [3]; ▼ and ♦ indicate strong strength-ductility values disclosed in reference [4]; ▲ indicates the strong strength-ductility value disclosed in reference [5]; ◇ indicates the strong strength-ductility value of Fe-22Mn-0.6C at −196 DEG C.

A product of strength and ductility is calculated in the tensile test according to embodiments 2-7, and a comparison with the prior art is made. It can be seen from FIG. 19 that the high manganese steel of the present invention features a best product of strength and ductility at low temperature after grain refining, specifically higher than 50 GPa • %.

A tensile fracture of a high manganese steel obtained by annealing at 550 DEG C. to 700 DEG C. is of a dimple type; a tensile fracture of a high manganese steel obtained by annealing at 800-1000 DEG C. is an intergranular fracture.

The tensile strength of a high manganese steel of fine grain size in the present invention at −180 DEG C. and −196 DEG C. is approximate to that of stainless steel 304 added with Ni 12% at −162 DEG C., its ductility is much higher than that of stainless steels 304 added with Ni 8% and Ni 12% at −162 DEG C., as shown in tensile curves of the stainless steels added with Ni 8% and Ni 12%, disclosed in *Effect of Ni content on the tensile properties and strain-induced martensite transformation for* 304 *stainless steel* (*Materials Science and Engineering A* 528(2011) 2277-2281) by Do-Yeal Ryoo, Namhyun Kang, Chung-Yun Kang.

TABLE 4

Related parameters of a high manganese steel plate in embodiments 2-7

| Sample status | Tensile temperature | Yield strength (MPa) | Tensile strength (MPa) | Elongation (%) | Grain size (μm) | Product of strength and ductility (MPa · %) |
|---|---|---|---|---|---|---|
| Embodiment 3 | −180 DEG C. | 612.50 | 982.92 | 49.1 | 2.0 | 48242 |
| Embodiment 4 | −180 DEG C. | 525.76 | 958.71 | 53.7 | 2.5 | 51521 |

TABLE 4-continued

Related parameters of a high manganese steel plate in embodiments 2-7

| Sample status | Tensile temperature | Yield strength (MPa) | Tensile strength (MPa) | Elongation (%) | Grain size (μm) | Product of strength and ductility (MPa · %) |
|---|---|---|---|---|---|---|
| Embodiment 2 | −180 DEG C. | 456.4 | 754.4 | 18.3 | 3.8 | 15163 |
| Embodiment 5 | −180 DEG C. | 413.58 | 634.39 | 9.2 | 10.8 | 5862 |
| Embodiment 6 | −180 DEG C. | 418.06 | 620.49 | 8.8 | 21.0 | 5496 |
| Embodiment 7 | −196 DEG C. | 1018 | 1193 | 40.0 | | 47720 |

Table 5 shows the requirements of Chinese Standard (GB24510-2009) on mechanical properties of low temperature steel 9Ni, and for high manganese steel of fine grain size in embodiments 3 and 4 of the invention and high manganese steel in embodiment 7, their yield strength, tensile strength and elongation already reach or exceed the requirements of the steel 9Ni at low temperature tensile performance.

TABLE 5

Tensile performance of steel plate in GB24510-2009

| Tensile test | brand | | |
|---|---|---|---|
| | 9Ni490 | 9Ni590A | 9Ni590B |
| Steel plate thickness/mm | t ≤30 30 < t ≤ 50 | t ≤30 30 < t ≤ 50 | t ≤30 30 < t ≤ 50 |
| Yield strength/MPa | ≥490 ≥480 | ≥590 ≥575 | ≥590 ≥575 |
| Tensile strength/MPa | 640-830 | 680-820 | 680-820 |
| Break elongation % | ≥18 | ≥18 | ≥18 |
| V impact test (transverse specimens) | | | |
| Test temperature/DEG C. | −196 | −196 | −196 |
| Impact energy absorption/J | ≥40 | ≥50 | ≥80 |

Embodiments 8-9

See table 6 for the percentage by weight of the components of the high manganese steel. Manufacturing steps are different from those in embodiment 2, and some steps have different parameters. For details, see table 6.

The steel plate obtained is subjected to tensile tests at −170 DEG C., −180 DEG C. and −196 DEG C. respectively. See data in table 6 for test results.

TABLE 6

Components of high manganese steel in embodiments 8-9 and tensile test results

| | | Embodiment 8 | Embodiment 9 |
|---|---|---|---|
| Percentage by weight of the components | Mn (%) | 32 | 35 |
| | C (%) | 0.04 | 0.04 |
| Manufacturing parameters | Solid solution treatment temperature/time (DEG C./h) | 1150 DEG C./4 h | 1200 DEG C./2 h |
| | Hot rolling temperature (DEG C.) | 800 DEG C.-900 DEG C. | 850 DEG C.-1000 DEG C. |
| | Post-hot-rolling homogenization temperature/time (DEG C./h) | 1000-1050 DEG C./2 h | 1020-1100 DEG C./1 h |
| | Annealing temperature/time (DEG C./h) | 800 DEG C./1 h | 710 DEG C./1 h |
| | Steel plate thickness | 1.5 mm | 2.0 mm |

TABLE 6-continued

| Components of high manganese steel in embodiments 8-9 and tensile test results | | | |
|---|---|---|---|
| | | Embodiment 8 | Embodiment 9 |
| Tensile performance test | Yield strength (MPa) −170 DEG C./−180 DEG C./−196 DEG C. | 430.4/440.5/457.2 | 504.4/515.5/519.2 |
| | Tensile strength (MPa) −170 DEG C./−180 DEG C./−196 DEG C. | 630.1/670.4/620.6 | 906.2/945.0/975.5 |
| | Elongation (%) −170 DEG C./−180 DEG C./−196 DEG C. | 24%/19.0%/18.5% | 50.1%/55.5%/43.9% |

The above results indicate that the high manganese steel in the present invention features optimal low-temperature ductility and higher tensile strength and yield strength at −170 DEG C. to −196 DEG C. The high manganese steel plate in the present invention is processed to 1.0-2.0 mm, its tensile strength and elongation values at −170 DEG C. to −196 DEG C. are much higher than the requirements of Chinese Standard on tensile properties of steel 09MnNiDR in the low temperature steel plate, and the steel plate has a promising prospect of application in low-temperature environments.

Embodiment 10

The high manganese steel in the embodiment comprises components in percentage by weight: Mn 34%, C 0.04%, S≤0.01%, P≤0.008% and the balance being Fe and unavoidable impurities. The contents of sulfur and phosphorous are subjected to impurity limiting conditions.

A machining technology comprises:

Step A, calculating a feeding ratio according to the foregoing percentage by weight of the high manganese steel, and smelting in the line frequency electric induction furnace and argon plus pressure ambient in the furnace, so as to prevent the volatilization of the Mn during smelting.

Step B, post-treating the steel ingot: keeping the steel ingot smelted in step A under the condition of 1150 DEG C.-1200 DEG C. and performing heat treatment for 2-4 hours, and then transferring the steel ingot into a water quenching tank at room temperature to complete solid solution treatment; after solid solution treatment, dissolving phases in the cast ingot, which is advantageous for improving toughness and corrosion resistance of the high manganese steel, relieving stress and softening.

Step C, cogging and rolling the steel ingot to form a plate: performing hot rolling, tempering and homogenizing after cogging the steel ingot after solid solution treatment.

Technological conditions for hot rolling and homogenizing are as follows: first, heating a crude plate to 800-1000 DEG C.; then, carrying out hot rolling into a tube with a wall thickness of 13 mm; after that, maintaining for 1-2 hours at 1000-1100 DEG C.; then, transferring to a room-temperature water quenching tank for homogenization. A purpose of homogenization is to remove stress concentration points generated by hot drawing to improve mechanical properties of the tubular product.

An EBSD (electron backscatter pattern) test is carried out for the tubular product in the present embodiment. It can be seen from FIG. 20 that the tubular product after hot drawing is of a fully austenitic structure, with the, mean grain size were measured to be 47 μm.

Tensile tests are carried out for the tubular product of the present embodiment in accordance with GB/T 13239-2006 (Metallic Materials-Tensile Testing at Low Temperature), the tensile strain rate is $10^{-3}$ $s^{-1}$. See Table 7 for results.

TABLE 7

| Tensile test results of Embodiment 10 | | | | |
|---|---|---|---|---|
| | | −170 DEG C. | −180 DEG C. | −196 DEG C. |
| Tensile performance test | Yield strength (MPa) | 550.4 | 575.2 | 590.4 |
| | Tensile strength (MPa) | 782.6 | 824.0 | 840.1 |
| | Ductility (%) | 36.0 | 33.0 | 30.0 |

It can be seen from table 7 that: after being homogenized, the hot-drawn tube has a yield strength that reaches 550 MPa-590 MPa, with the tensile strength being 782-840 MPa and the elongation being 30.0-36.0%; moreover, with the fracture being a dimple fracture, it can be used directly for the processing and using of low-temperature devices.

Embodiment 11

Based on embodiment 10, cold drawing and annealing homogenization are carried out for the hot-drawn tube for molding.

Conditions of cold drawing and annealing homogenization are as follows: cold-drawing the hot-drawn tubular product after homogenization at room temperature to make it into a thin wall tube with a wall thickness of 1.0-2.0 mm; maintaining the thin wall tube for 1 hour at 800-850 DEG C.; after that, transferring to a room-temperature water quenching tank to complete annealing homogenization.

Prior to annealing, an X-ray diffraction test is carried out for the thin wall tubular product, and its XRD view is shown in FIG. 21; the thin wall tubular product is annealed at 800-850 DEG C.; after that, an XRD test and EBSD (electron backscatter pattern) test are carried out, which are shown in FIG. 22 and FIG. 23 respectively.

It can be seen from FIG. 21 that the thin wall tubular product after cold drawing is the austenitic structure that is of a fully face-centered-cubic structure; it can be seen from FIG. 22 that the thin wall tubular product which has been annealed for 1 hour is still the austenitic structure that is of a fully face-centered-cubic structure, and there is no phase transition; FIG. 23 shows that the thin wall tube is: the mean grain size was measured to be 4 μm with annealing twin boundaries also counted for the grain size measurement.

Tensile tests are carried out for the thin wall tubular product in the present embodiment according to the method of embodiment 1. FIG. 24 shows a tensile curve under the condition of −180 DEG C. Table 8 shows the tensile test results at different temperatures. It can be seen from the table that: the thin wall steel tube has a yield strength of 420-460.7 MPa (σ0.2), a tensile strength of 660.7-800.4 MPa (σb) and a uniform ductility of 18.0-37.8%.

TABLE 8

Tensile test results of a tubular product in embodiment 11

| | | −170 DEG C. | −180 DEG C. | −196 DEG C. |
|---|---|---|---|---|
| Tensile performance test | Yield strength (MPa) | 440.2 | 460.7 | 420.1 |
| | Tensile strength (MPa) | 800.4 | 680.7 | 660.7 |
| | Ductility (%) | 37.8 | 22.0 | 18.0 |

tensile sample release stress, which makes the tube's uniform ductility reach more than 18%, thus improving the low temperature plasticity of this kind of tubes.

Embodiments 12-13

See Table 9 for the percentage by weight of the components of a high manganese steel. Processing steps of a tubular product are the same as those of embodiment 11. For technological parameters, refer to table data. Tensile tests are carried out for the tubular product obtained through drawing according to the method of embodiment 1, and for its results, refer to the data shown in Table 9.

TABLE 9

Components of high manganese steel in embodiments 12-13 and tensile test results

| | | Embodiment 12 | Embodiment 13 |
|---|---|---|---|
| Component (%) | Mn (%) | 32 | 35 |
| | C (%) | 0.04 | 0.04 |
| Process parameter | Solution treatment temperature/time (DEG C./h) | 1150 DEG C./2 h | 1200 DEG C./0.5 h |
| | Thermal drawing temperature (DEG C.) | 800 DEG C.-900 DEG C. | 900 DEG C.-1000 DEG C. |
| | Annealing temperature/time (DEG C./h) | 850 DEG C./0.5 h | 780 DEG C./2 h |
| | Thickness of tubular product with thin wall | 1.5 mm | 2 mm |
| Tensile performance test | Yield strength (MPa) −170 DEG C./−180 DEG C./−196 DEG C. | 420.3/450.9/490.4 | 455.2/475.6/501.4 |
| | Tensile strength (MPa) −170 DEG C./−180 DEG C./−196 DEG C. | 810.6/660.6/620.5 | 835.5/675.8/670.2 |
| | Stretching rate (%) −170 DEG C./−180 DEG C./−196 DEG C. | 34.2/20.2/18.1 | 35.2/25.5/18.2 |

An SEM test is carried out for the tensile fracture of a tensile sample. Referring to FIG. 25 and FIG. 26, SEM photographs show that the tensile sample belongs to a typical intergranular fracture, which is a typical brittle fracture.

Analysis of results: it is generally believed that an intergranular fracture is a brittle fracture, and materials leading to brittle fracture have no plasticity (namely, the average ductility is smaller than 5%), and that once a brittle fracture occurs, it will expand at an extremely fast rate, which will lead to the fracture of the whole. Although the designed material in the present invention belongs to a brittle fracture, it has a uniform tensile ductility of more than 18%, and relatively high yield strength and tensile strength, which is not only one of the key points of the present invention, but also the important parameter enabling it to be used in low temperature environment.

After the tensile sample is fractured, a large quantity of micro-cracks, which are perpendicular to the tensile direction, are distributed parallel on the surface of the sample along the tensile direction. Micro-cracks produce on the surface of the sample and have a crack width of 3-5 mm and a depth of about 4-8 mm which is approximately equal to one or two grain sizes. Preliminary analysis: a large quantity of micro-cracks which are distributed on the surface of the The above results indicate: the high manganese steel tubular product with a thin wall prepared by the present invention features optimal low-temperature plasticity between −170 DEG C. and −196 DEG C. and higher tensile strength and yield strength.

The invention claimed is:

1. A machining technology of a low-temperature high-strength-ductility high manganese steel plate, comprising process steps of smelting high manganese steel, post-treating a steel ingot, and cogging and rolling to form a plate, wherein the process steps comprise the following parameters:

A. smelting the high manganese steel: calculating a feeding ratio according to the percentage by weight of components in the high manganese steel: Mn 30%-36%, C 0.02%-0.06%, S≤0.01%, P≤0.008% and the balance being Fe, and smelting the components into the steel ingot;

B. post-treating the steel ingot: keeping the steel ingot smelted in step A under the condition of 1150 DEG C.-1200 DEG C. and performing heat treatment for 2-4 hours, and then transferring the steel ingot into a water quenching tank at room temperature to complete solid solution treatment; and C. cogging and rolling the steel ingot to form a plate: performing hot rolling, tempering and homogenizing after cogging the steel ingot after solid solution treatment.

2. The machining technology of the low-temperature high-strength-ductility high manganese steel plate of claim 1, wherein the content of Mn in percentage by weight in the high manganese steel obtained in step A is 32%-35%, and an industrial frequency electric induction furnace and a furnace argon positive pressure environment are adopted for the melting of the high manganese steel.

3. The machining technology of the low-temperature high-strength-ductility high manganese steel plate of claim 1, wherein the technology conditions of hot-rolling and homogenizing in step C comprise: firstly, heating steel ingot blanks to 800-1000 DEG C.; then, hot-rolling the steel ingot blanks to obtain a crude plate with a thickness of 10-20 mm; then, maintaining the crude plate at 1000-1100 DEG C. for 1-2 hours, and transferring the crude plate to a room-temperature water quenching tank for homogenization.

4. The machining technology of the low-temperature high-strength-ductility high manganese steel plate of claim 1, wherein further comprising step D: performing cold-rolling, annealing and homogenizing forming on the crude plate after being hot-rolled and homogenized.

5. The machining technology of the low-temperature high-strength-ductility high manganese steel plate of claim 4, wherein the conditions of cold-rolling and homogenizing in step D comprise: performing cold-rolling for 10-20 passes at room temperature on the crude plate after being hot-rolled and homogenized to form a plate with a thickness of 1.0-2.0 mm, the rolling reduction is 90%-93%; maintaining the steel plate under 500-1000 DEG C. for 0.5-2 hours, then transferring the steel plate to the room temperature water quenching tank for homogenization.

6. The machining technology of the low-temperature high-strength-ductility high manganese steel plate of claim 5, wherein comprising the steps of maintaining the steel plate after being cold-rolled in step D at 500-710 DEG C. for 1 hour, and then transferring the steel plate to the room temperature water quenching tank for homogenization, the obtained steel plate has dimple fractures in toughness cracks under the conditions of −196 DEG C. to −180 DEG C. and constant pressure, and the product strength and uniform elongation exceeds 50 GPa %.

7. The machining technology of the low-temperature high-strength-ductility high manganese steel plate of claim 5, wherein comprising the steps of maintaining the steel plate after being cold-rolled in step D at 800-1000 DEG C. for 1 hour, and then transferring the steel plate to the room temperature water quenching tank for homogenization, the obtained steel plate has the characteristic of intergranular fractures under the conditions of −196 DEG C. to −170 DEG C. and constant pressure, and mechanical performance indexes comprise: yield strength: higher than 410 MPa, tensile strength: higher than 620 MPa, and elongation: greater than 8%.

8. A machining technology of a low-temperature high-strength-ductility high manganese steel tubular product, comprising process steps of smelting high manganese steel, post-treating a steel ingot, and cogging and rolling to form a plate, wherein the process steps comprise the following parameters:

step A. calculating a feeding ratio according to the percentage by weight of components in the high manganese steel: Mn 30%-36%, C 0.02%-0.06%, S≤0.01%, P≤0.008% and the balance being Fe, and smelting the components into the steel ingot;

step B. post-treating the steel ingot: maintaining the steel ingot smelted in step A under the condition of 1150 DEG C.-1200 DEG C., performing heat treatment for 2-4 hours, and then transferring the steel ingot into the room temperature water quenching tank to complete solid solution treatment; and step C. cogging and drawing to obtain the tubular product: performing hot rolling, tempering and homogenizing on the steel ingot after cogging the steel ingot on which solid solution treatment is performed.

9. The machining technology of a low-temperature high-strength-ductility high manganese steel tubular product of claim 8, wherein further comprising step D: cold-drawing the tubular product at room temperature after the hot drawing and homogenizing into a thin-wall tubular product with a wall thickness of 1.0 mm-2.0 mm, maintaining the thin-wall tubular product at 600 DEG C. to 850 DEG C. for 0.5-2 hours, and then transferring into a water quenching tank for homogenization.

10. The machining technology of the low-temperature high-strength-ductility high manganese tubular product of claim 8, wherein the content of Mn in percentage by weight in the components of the high manganese steel is 32%-35%, and the content of C in percentage by weight is 0.04%.

* * * * *